US005918996A

United States Patent [19]

Coolbaugh

[11] Patent Number: 5,918,996

[45] Date of Patent: Jul. 6, 1999

[54] COMBINATION TOOTHBRUSH AND TOOTHPASTE DISPENSER

[76] Inventor: Susan A. Coolbaugh, 6708 Carriage La., Colleyville, Tex. 76034

[21] Appl. No.: 09/010,506

[22] Filed: Jan. 22, 1998

[51] Int. Cl.[6] ..... B43K 5/06

[52] U.S. Cl. ..... 401/175; 401/174

[58] Field of Search ..... 401/175, 174, 401/172, 171, 275, 277

[56] References Cited

U.S. PATENT DOCUMENTS

| | | | |
|---|---|---|---|
| 4,288,169 | 9/1981 | McMenamin, IV | 401/175 |
| 4,622,984 | 11/1986 | Gaebel | 401/175 |
| 4,655,627 | 4/1987 | Bradley | 401/175 |
| 4,957,125 | 9/1990 | Yaneza | 401/175 |
| 5,026,191 | 6/1991 | Akly | 401/175 |
| 5,066,155 | 11/1991 | English et al. | 401/175 |
| 5,746,523 | 5/1998 | Megill et al. | 401/175 |

*Primary Examiner*—David J. Walczak

[57] ABSTRACT

A new combination toothbrush and toothpaste dispenser for combining a toothbrush and toothpaste in one compact unit. The inventive device includes a cylindrical handle having opposed open ends and a cylindrical side wall disposed therebetween. The cylindrical handle holds a quantity of toothpaste therein. A toothbrush portion is secured within one of the opposed open ends of the cylindrical handle. The toothbrush portion has a plurality of bristles extending upwardly from an outer end thereof. The outer end has a channel extending inwardly therefrom into communication with the open end of the cylindrical handle. The channel has an open outer end disposed within the plurality of bristles. A toothpaste propelling portion is disposed within the opposed open end of the cylindrical handle opposite the toothbrush portion. An elongated window is disposed within the cylindrical side wall of the cylindrical handle.

9 Claims, 2 Drawing Sheets

COMBINATION TOOTHBRUSH AND TOOTHPASTE DISPENSER

BACKGROUND OF THE INVENTION

1. Field of the Invention

The present invention relates to toothbrushes and more particularly pertains to a new combination toothbrush and toothpaste dispenser for combining a toothbrush and toothpaste in one compact unit.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrushes include U.S. Pat. No. 3,995,648 to Kuryla; U.S. Pat. No. 5,439,014 to Moussa; U.S. Pat. No. Des. 347,944 to Honora; U.S. Pat. No. 4,717,278 to Kemeny; U.S. Pat. No. 5,039,244 to Cheng; and U.S. Pat. No. Des. 353,051 to Lonon.

While these devices fulfill their respective, particular objectives and requirements, the aforementioned patents do not disclose a new combination toothbrush and toothpaste dispenser. The inventive device includes a cylindrical handle having opposed open ends and a cylindrical side wall disposed therebetween. The cylindrical handle holds a quantity of toothpaste therein. A toothbrush portion is secured within one of the opposed open ends of the cylindrical handle. The toothbrush portion has a plurality of bristles extending upwardly from an outer end thereof. The outer end has a channel extending inwardly therefrom into communication with the open end of the cylindrical handle. The channel has an open outer end disposed within the plurality of bristles. A toothpaste propelling portion is disposed within the opposed open end of the cylindrical handle opposite the toothbrush portion. An elongated window is disposed within the cylindrical side wall of the cylindrical handle.

In these respects, the combination toothbrush and toothpaste dispenser according to the present invention substantially departs from the conventional concepts and designs of the prior art, and in so doing provides an apparatus primarily developed for the purpose of combining a toothbrush and toothpaste in one compact unit.

SUMMARY OF THE INVENTION

In view of the foregoing disadvantages inherent in the known types of toothbrushes now present in the prior art, the present invention provides a new combination toothbrush and toothpaste dispenser construction wherein the same can be utilized for combining a toothbrush and toothpaste in one compact unit.

The general purpose of the present invention, which will be described subsequently in greater detail, is to provide a new combination toothbrush and toothpaste dispenser apparatus and method which has many of the advantages of the toothbrushes mentioned heretofore and many novel features that result in a new combination toothbrush and toothpaste dispenser which is not anticipated, rendered obvious, suggested, or even implied by any of the prior art toothbrushes, either alone or in any combination thereof.

To attain this, the present invention generally comprises a cylindrical handle having opposed open ends and a cylindrical side wall disposed therebetween. The cylindrical handle holds a quantity of toothpaste therein. A toothbrush portion is secured within one of the opposed open ends of the cylindrical handle. The toothbrush portion has a plurality of bristles extending upwardly from an outer end thereof. The outer end has a channel extending inwardly therefrom into communication with the open end of the cylindrical handle. The channel has an open outer end disposed within the plurality of bristles. A cap portion is dimensioned for removable coupling with the open end of the cylindrical handle over the toothbrush portion. A toothpaste propelling portion is disposed within the opposed open end of the cylindrical handle opposite the toothbrush portion. The toothpaste propelling portion includes a handle rotatably disposed within the open end of the cylindrical handle. The handle has a threaded rod extending inwardly therefrom. The threaded rod extends interiorly of the cylindrical handle. The threaded rod has a push plate disposed thereon whereby turning of the handle will facilitate inward movement of the push plate thereby propelling the toothpaste outwardly of the open end of the channel into the plurality of bristles. An elongated window is disposed within the cylindrical side wall of the cylindrical handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination toothbrush and toothpaste dispenser apparatus and method which has many of the advantages of the toothbrushes mentioned heretofore and many novel features that result in a new combination toothbrush and toothpaste dispenser which is not anticipated, rendered obvious, suggested, or even implied by any of the prior art toothbrushes, either alone or in any combination thereof.

It is another object of the present invention to provide a new combination toothbrush and toothpaste dispenser which may be easily and efficiently manufactured and marketed.

It is a further object of the present invention to provide a new combination toothbrush and toothpaste dispenser which is of a durable and reliable construction.

An even further object of the present invention is to provide a new combination toothbrush and toothpaste dispenser which is susceptible of a low cost of manufacture with regard to both materials and labor, and which accordingly is then susceptible of low prices of sale to the consuming public, thereby making such combination toothbrush and toothpaste dispenser economically available to the buying public.

Still yet another object of the present invention is to provide a new combination toothbrush and toothpaste dispenser which provides in the apparatuses and methods of the prior art some of the advantages thereof, while simultaneously overcoming some of the disadvantages normally associated therewith.

Still another object of the present invention is to provide a new combination toothbrush and toothpaste dispenser for combining a toothbrush and toothpaste in one compact unit.

Yet another object of the present invention is to provide a new combination toothbrush and toothpaste dispenser which includes a cylindrical handle having opposed open ends and a cylindrical side wall disposed therebetween. The cylindrical handle holds a quantity of toothpaste therein. A toothbrush portion is secured within one of the opposed open ends of the cylindrical handle. The toothbrush portion has a plurality of bristles extending upwardly from an outer end thereof. The outer end has a channel extending inwardly therefrom into communication with the open end of the cylindrical handle. The channel has an open outer end disposed within the plurality of bristles. A toothpaste propelling portion is disposed within the opposed open end of the cylindrical handle opposite the toothbrush portion. An elongated window is disposed within the cylindrical side wall of the cylindrical handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
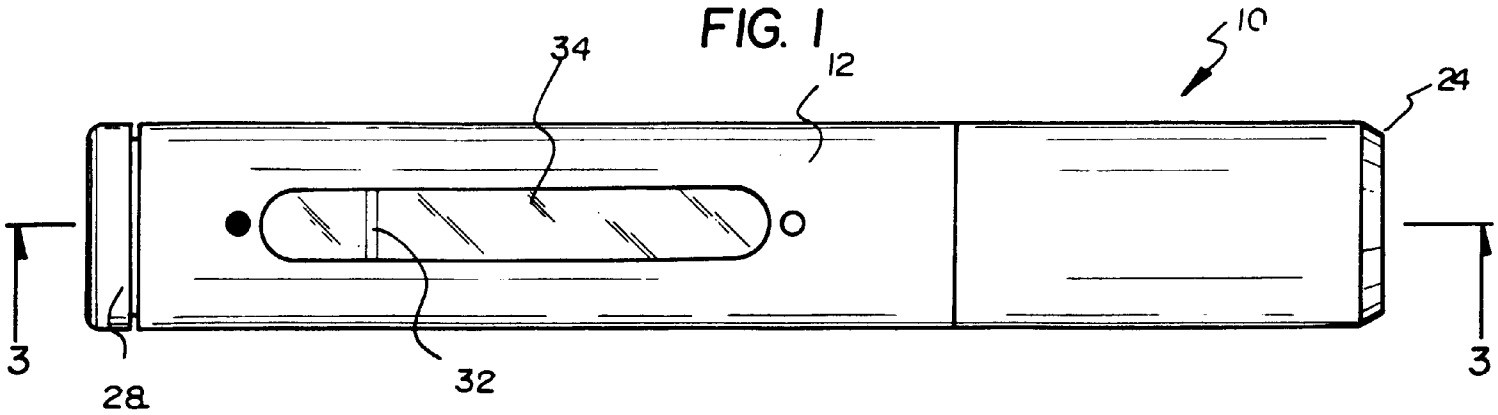
FIG. 1 is a side view of a new combination toothbrush and toothpaste dispenser according to the present invention.
Figure 2:
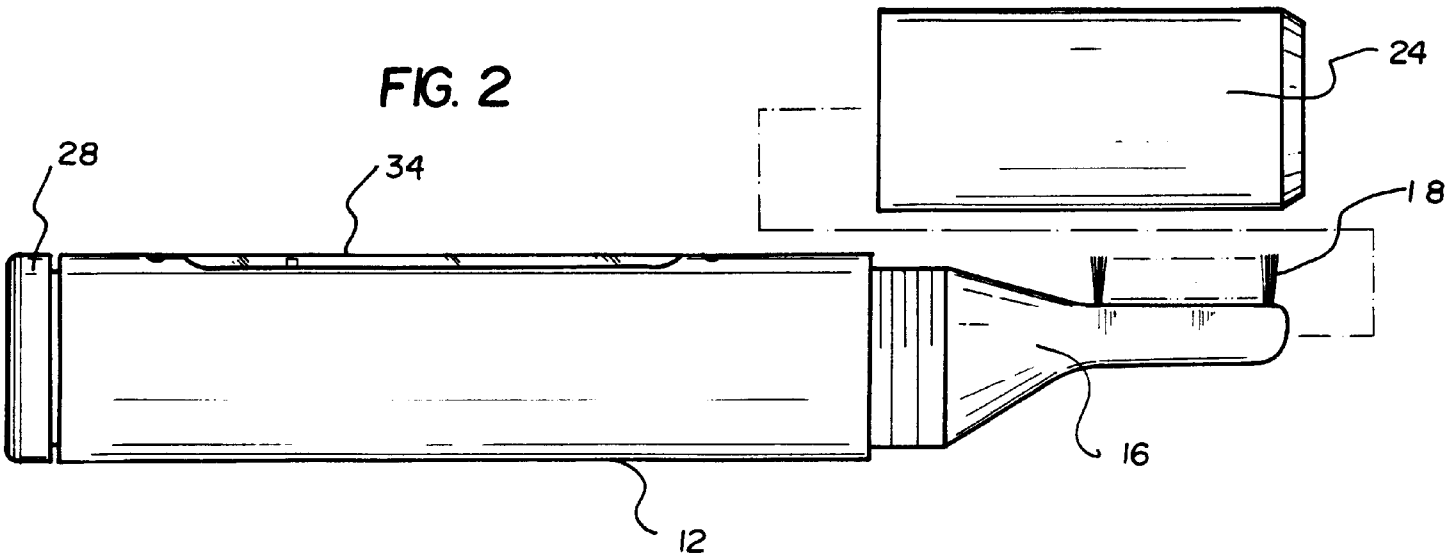
FIG. 2 is a side view of the present invention illustrated with the cap removed therefrom.
Figure 3:
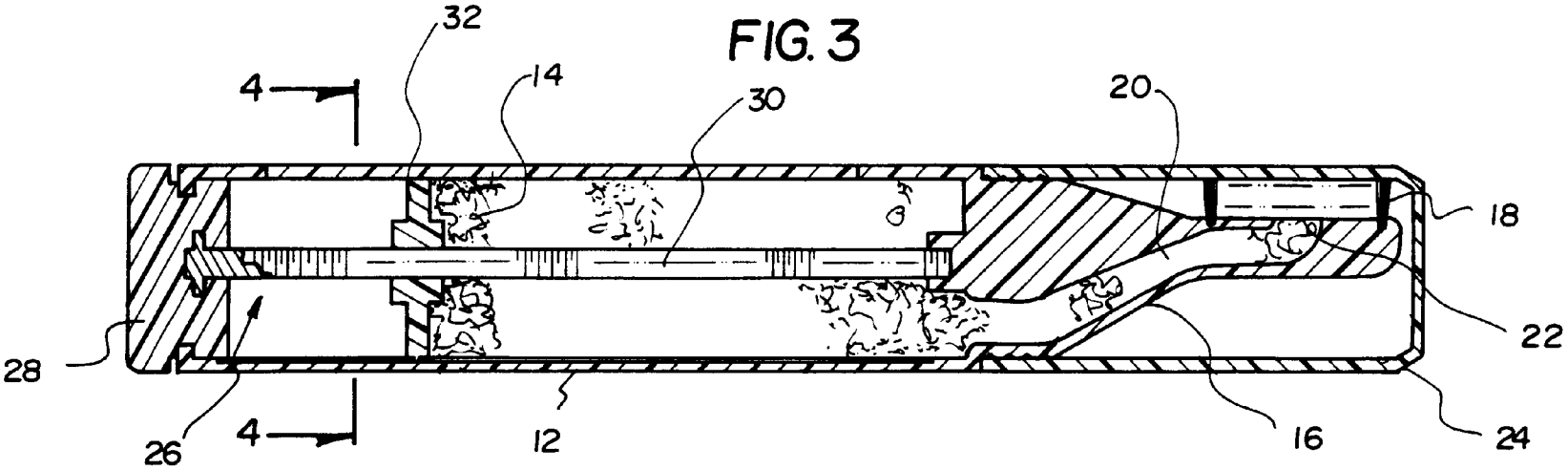
FIG. 3 is a cross-sectional view of the present invention as taken along line 3—3 of FIG. 1.
Figure 4:
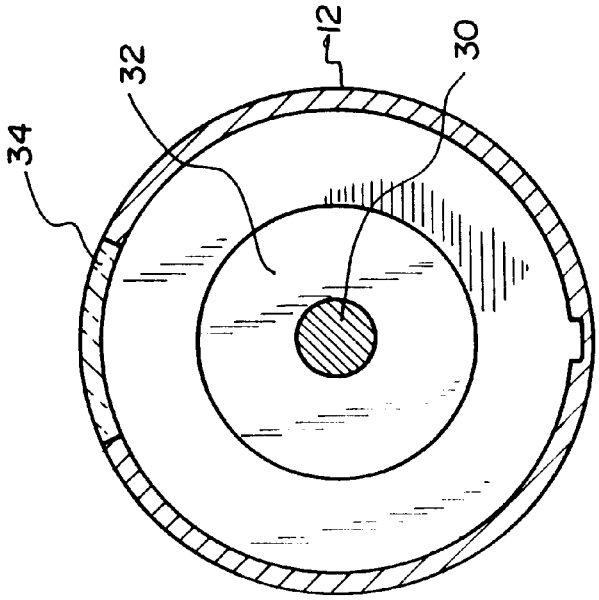
FIG. 4 is a cross-sectional view of the present invention as taken along line 4—4 of FIG. 3.

With reference now to the drawings, and in particular to FIGS. 1 through 4 thereof, a new combination toothbrush and toothpaste dispenser embodying the principles and concepts of the present invention and generally designated by the reference numeral will be described.

As best illustrated in FIGS. 1 through 4, the combination toothbrush and toothpaste dispenser 10 comprises a cylindrical handle 12 having opposed ends and a cylindrical side wall disposed therebetween. One of the ends is open. The cylindrical handle 12 holds a quantity of toothpaste 14 therein.

A toothbrush portion 16 is secured to one of the opposed ends of the cylindrical handle 12. The toothbrush portion 16 has a plurality of bristles 18 extending upwardly from an outer end thereof. The outer end has a channel 20 extending inwardly therefrom into communication with the open end of the cylindrical handle 12. The channel 20 has an open outer end 22 disposed within the plurality of bristles 18.

A cap portion 24 is dimensioned for removable coupling with the end of the cylindrical handle 12 over the toothbrush portion 16.

A toothpaste propelling portion 26 is disposed within the opposed open end of the cylindrical handle 12 opposite the toothbrush portion 16. The toothpaste propelling portion 26 includes a handle 28 rotatably disposed within the open end of the cylindrical handle 12. The handle 28 has a threaded rod 30 extending inwardly therefrom. The threaded rod 30 extends interiorly of the cylindrical handle 12. The threaded rod 30 has a push plate 32 disposed thereon whereby turning of the handle 28 will facilitate inward movement of the push plate 32 thereby propelling the toothpaste 14 outwardly of the open end of the channel 20 into the plurality of bristles 18.

An elongated window 34 is disposed within the cylindrical side wall of the cylindrical handle 12.

In use, the toothpaste 14 rests within the cylindrical handle 12 and would be propelled to the toothbrush portion 16 by turning the handle 28. This would cause the push plate 32 within the cylindrical handle 12 to travel axially towards the toothbrush portion 16 on the threaded rod 30. This would force the toothpaste 14 through the cylindrical handle 12 to the plurality of bristles 18, where the paste 14 would emit through the open end 22 of the channel 20. One turn of the handle 28 would dispense the recommended amount of paste 14 upon the bristles 18. The exterior of the cylindrical handle 12 includes a gauge, represented by the elongated window 34, through which the user could easily view the supply of paste 14. The cap portion 24 would safeguard the toothbrush portion 16 during storage or transport.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush with a toothpaste dispenser for combining a toothbrush and toothpaste in one compact unit comprising:

a cylindrical handle having opposed ends and a cylindrical side wall disposed therebetween, one of the ends being open, the cylindrical handle holding a quantity of toothpaste therein;

a toothbrush portion secured to one of the opposed ends of the cylindrical handle, the toothbrush portion having a plurality of bristles extending upwardly from an outer end thereof, the bristles defining an elongate bristled portion of the outer end of the toothbrush portion, the outer end having a channel extending inwardly therefrom into communication with the open end of the cylindrical handle, the channel having an open outer end disposed within the plurality of bristles, the open outer end of the channel having a longitudinal length less than about ½ a length of the bristled portion of the outer end of the toothbrush portion for providing a compact handle and toothbrush portion combination;

a cap portion dimensioned for removable coupling with the end of the cylindrical handle over the toothbrush portion, the cap portion being threadedly mounted on the toothbrush portion to prevent accidental removal of the cap portion;

a toothpaste propelling portion disposed within the open end of the cylindrical handle opposite the toothbrush portion, the toothpaste propelling portion including a handle rotatably disposed within the open end of the cylindrical handle, the handle having a threaded rod extending inwardly therefrom, the threaded rod extending interiorly of the cylindrical handle, the threaded rod having a push plate disposed thereon whereby turning of the handle will facilitate inward movement of the push plate thereby propelling the toothpaste outwardly of the open end of the channel into the plurality of bristles;

an elongated window disposed within the cylindrical side wall of the cylindrical handle, the window having a pair of arcuate ends, a pair of sides extending between the ends, and inner and outer surfaces, wherein the outer surface of the window has an arcuate shape corresponding to the curvature of an outer perimeter of the cylindrical handle, the outer surface of the window and an outer surface of the cylindrical side wall of the cylindrical handle forming a continuous surface, the inner surface of the window and an inner surface of the cylindrical side wall of the cylindrical handle forming a continuous surface, wherein a width of the window is defined between the sides of the window, the width of the window being between about ¼ and ½ the length of an outer diameter of the cylindrical handle such that the thin outer portion of the push plate is visible through the window when viewed from a point on a plane extending across the sides of the window;

wherein the push plate has a thick inner portion and a thin outer portion, the thick inner portion being for preventing deformation of the push plate around the threaded rod, the thin outer portion being for providing a more accurate visual indication of its position along the window; and the cylindrical handle having a guide groove extending into the inner surface of the cylindrical side wall of the cylindrical handle and extending between the ends of the cylindrical handle, the guide groove being positioned opposite the window, the thin outer portion of the push plate having a flange extending therefrom into said groove of the cylindrical handle for preventing rotation of the push plate.

2. A toothbrush with a toothpaste dispenser for combining a toothbrush and toothpaste in one compact unit, comprising:

a cylindrical handle having opposed ends and a cylindrical side wall disposed therebetween, one of the ends being open, the cylindrical handle holding a quantity of toothpaste therein;

a toothbrush portion secured to one of the opposed ends of the cylindrical handle, the toothbrush portion having a plurality of bristles extending upwardly from an outer end thereof, the outer end having a channel extending inwardly therefrom into communication with the end of the cylindrical handle, the channel having an open outer end disposed within the plurality of bristles;

a toothpaste propelling portion disposed within the opposed open end of the cylindrical handle opposite the toothbrush portion; and an elongated window disposed within the cylindrical side wall of the cylindrical handle, the window having a pair of arcuate ends, a pair of sides extending between the ends, and inner and outer surfaces, wherein the outer surface of the window has an arcuate shape corresponding to the curvature of an outer perimeter of the cylindrical handle, the outer surface of the window and an outer surface of the cylindrical side wall of the cylindrical handle forming a continuous surface, the inner surface of the window and an inner surface of the cylindrical side wall of the cylindrical handle forming a continuous surface.

3. The toothbrush as set forth in claim 2 and further including a cap portion dimensioned for removable coupling with the end of the cylindrical handle over the toothbrush portion.

4. The toothbrush as set forth in claim 2 wherein the toothpaste propelling portion includes a handle rotatably disposed within the open end of the cylindrical handle, the handle having a threaded rod extending inwardly therefrom, the threaded rod extending interiorly of the cylindrical handle, the threaded rod having a push plate disposed thereon whereby turning of the handle will facilitate inward movement of the push plate thereby propelling the toothpaste outwardly of the open end of the channel into the plurality of bristles.

5. The toothbrush as set forth in claim 4, wherein the push plate has a thick inner portion and a thin outer portion, the thick inner portion being for preventing deformation of the push plate around the threaded rod, the thin outer portion being for providing a more accurate visual indication of its position along the window.

6. The toothbrush as set forth in claim 5, wherein a width of the window is defined between the sides of the window, the width of the window being between about ¼ and ½ the length of an outer diameter of the cylindrical handle such that the thin outer portion of the push plate is visible through the window when viewed from a point on a plane extending across the sides of the window.

7. The toothbrush as set forth in claim 5, wherein the cylindrical handle has a guide groove that extends into the inner surface of the cylindrical side wall of the cylindrical handle and extends between the ends of the cylindrical handle, the guide groove being positioned opposite the window, the thin outer portion of the push plate having a flange extending therefrom into said groove of the cylindrical handle for preventing rotation of the push plate.

8. The toothbrush as set forth in claim 5, curther comprising a cap portion dimensioned for removable coupling with the end of the cylindrical handle over the toothbrush portion, the cap portion being threadedly mounted on the toothbrush portion to prevent accidental removal of the cap portion.

9. The toothbrush as set forth in claim 2, wherein the bristles define an elongate bristled portion of the outer end of the toothbrush portion, the open outer end of the channel having a longitudinal length of between about ¼ and ½ a length of the bristled portion of the outer end of the toothbrush portion.

* * * * *